United States Patent [19]

Burmeister et al.

[11] 4,439,163

[45] Mar. 27, 1984

[54] OUTBOARD MOTOR WITH INTERLOCK MECHANISM FOR TRANSMISSION AND FOR STARTING MECHANISM

[75] Inventors: Dennis N. Burmeister, Libertyville, Ill.; Thomas A. Busse, Bristol, Wis.; Wesley C. Jones, Antioch, Ill.

[73] Assignee: Outboard Marine Corporation, Waukegan, Ill.

[21] Appl. No.: 192,917

[22] Filed: Oct. 1, 1980 (Under 37 CFR 1.47)

[51] Int. Cl.[3] ..... F02N 17/00

[52] U.S. Cl. ..... 440/86; 440/75; 440/84; 123/413; 74/850; 74/872; 74/480 B

[58] Field of Search ..... 440/75, 84, 86; 123/413; 74/475–477, 480 R, 480 B, 520, 843, 850, 878, 569, 877, 879, 872–874

[56] References Cited

U.S. PATENT DOCUMENTS

| | | | |
|---|---|---|---|
| 2,635,576 | 4/1953 | Kieckhaffer | 440/87 |
| 2,729,186 | 1/1956 | Kloss | 440/86 |
| 2,867,131 | 1/1959 | Shroeder | 74/850 |
| 2,867,132 | 1/1959 | Schroeder | 440/86 |
| 2,906,251 | 9/1959 | Soder | 123/413 |
| 2,988,929 | 6/1961 | Williams | 74/878 |
| 3,169,616 | 2/1965 | Hunsaker | 74/477 |
| 3,272,022 | 9/1966 | Spinner | 74/569 |
| 3,317,012 | 5/1967 | Heidner | 74/477 |
| 3,782,350 | 1/1974 | McBride | 74/850 |
| 4,144,456 | 3/1979 | Baba | 74/480 B |
| 4,195,534 | 4/1980 | Prince | 74/480 B |
| 4,253,349 | 3/1981 | Floeter | 74/480 B |

*Primary Examiner*—Trygve M. Blix
*Assistant Examiner*—Stephen P. Avila
*Attorney, Agent, or Firm*—Robert E. Clemency

[57] ABSTRACT

Disclosed herein is an outboard motor comprising a steerable and tiltable propulsion unit including an engine, a speed control mechanism movable from an idle speed setting to range of advanced speed settings, a starting mechanism operable to start the engine, a transmission shiftable between a neutral position and a drive position, and a mechanism connected to the transmission for preventing starting of the engine when the transmission is absent from the neutral position, and for preventing shifting of the transmission to the neutral position when the speed control mechanism is at a setting advanced from the idle setting, and for releasably holding the transmission in the neutral position, and for biasing the transmission from the neutral position and toward the drive position upon release of the transmission from the neutral position.

14 Claims, 6 Drawing Figures

OUTBOARD MOTOR WITH INTERLOCK MECHANISM FOR TRANSMISSION AND FOR STARTING MECHANISM

BACKGROUND OF THE DISCLOSURE

The invention relates to marine propulsion devices, and more particularly, to outboard motors including an engine and a transmission shiftable between a neutral position and a drive position, together with a starting mechanism, and means for controlling engine speed between an idle setting and a range of advance speed settings beyond the idle setting. Still more particularly, the invention relates to regulating the operation of the transmission in accordance with the speed of the engine and regulating the starting of the engine in accordance with the condition of the transmission.

It is desirable that shifting of the transmission be prevented when the engine is operating above idle speed and that operation of the starting mechanism be precluded when the transmission is not in neutral. In addition, it is desirable that an operator be able to "feel" the neutral condition of the transmission and that the transmission be automatically releasably held in neutral and additionally biased toward the drive position upon release from the neutral position by the operator.

SUMMARY OF THE INVENTION

The invention provides an outboard motor comprising a steerable and tiltable propulsion unit including a transmission shiftable between a neutral position and a drive position, and means for releasably holding the transmission in the neutral position and for biasing the transmission from the neutral position and toward the drive position upon release of the transmission from the neutral position.

The invention also provides an outboard motor comprising a steerable and tiltable propulsion unit including an engine speed control means movable from an idle speed setting to a range of advanced speed settings, a transmission shiftable between a neutral position and a drive position, and means for releasably holding the transmission in the neutral position, and for biasing the transmission from the neutral position and toward the drive position upon release of the transmission from the neutral position, and for preventing shifting of the transmission to neutral when the speed control means is at a setting advanced from the idle setting.

In one embodiment, the outboard motor is provided with means connected to the transmission for preventing starting of the engine when the transmission is absent from the neutral position, and for preventing shifting of the transmission to the neutral position when the speed control means is at a setting advanced from the idle setting, and for releasably holding the transmission in the neutral position, and for biasing the transmission from the neutral position and toward the drive position upon release of the transmission from the neutral position.

The invention also provides an outboard motor comprising a steerable and tiltable propulsion unit including an engine having a timer plate movable from an idle speed setting to a range of advanced speed settings, a transmission shiftable between a neutral position and a drive position, and means for preventing shifting of the transmission to neutral when the timer plate is at a setting advanced from the idle setting.

In addition, the invention also provides an outboard motor comprising a steerable and tiltable propulsion unit including an engine, speed control means movable from an idle speed setting to a range of advanced speed settings, a starting mechanism operable to start the engine, a transmission shiftable between a neutral position and a drive position, and means connected to the transmission for preventing starting of the engine when the transmission is absent from the neutral position, and for preventing shifting of the transmission to the neutral position when the speed control means is at a setting advanced from the idle setting.

Still further in addition, the invention provides an outboard motor comprising a steerable and tiltable propulsion unit including a transmission shiftable between a neutral position and a drive position, and means for releasably holding the transmission in the neutral position comprising an arm movable pivotally in response to shifting of the transmission and including a cam surface having a dished detent segment at a first radius from the axis of arm movement and a second segment at a lesser radius from the axis of arm movement, a detent lever movably mounted on the propulsion unit and including a follower located for engagement with the cam surface, and means releasably biasing the detent lever for engagement of the follower with the cam surface.

Other features and advantages of the invention will become known by reference to the following drawings, general description and claims.

THE DRAWINGS

Figure 1:
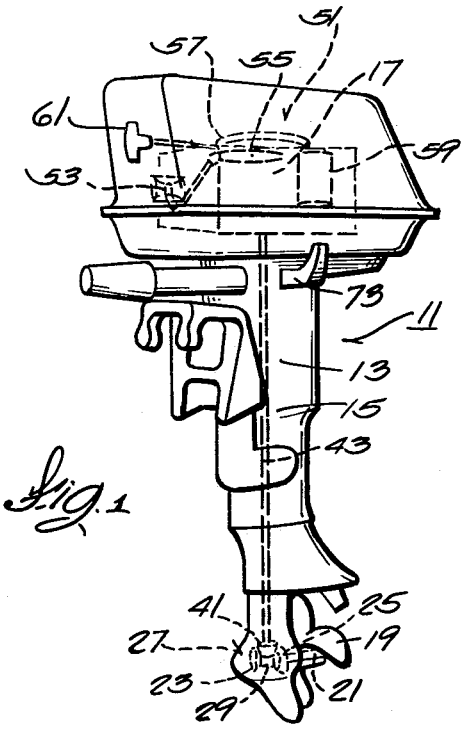
FIG. 1 is an enlarged and partially schematic view of an outboard motor including various of the features of the invention.
Figure 4:
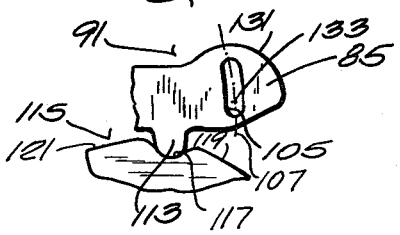
Figure 2:
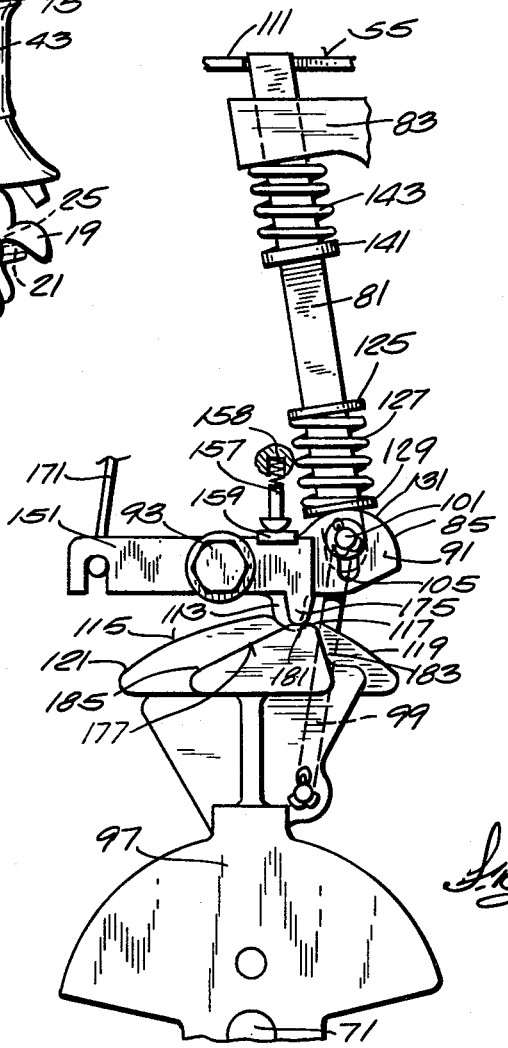
FIG. 2 is a partially schematic view, with parts omitted, of a portion of the mechanism included in the outboard motor shown in FIG. 1.
Figure 3:
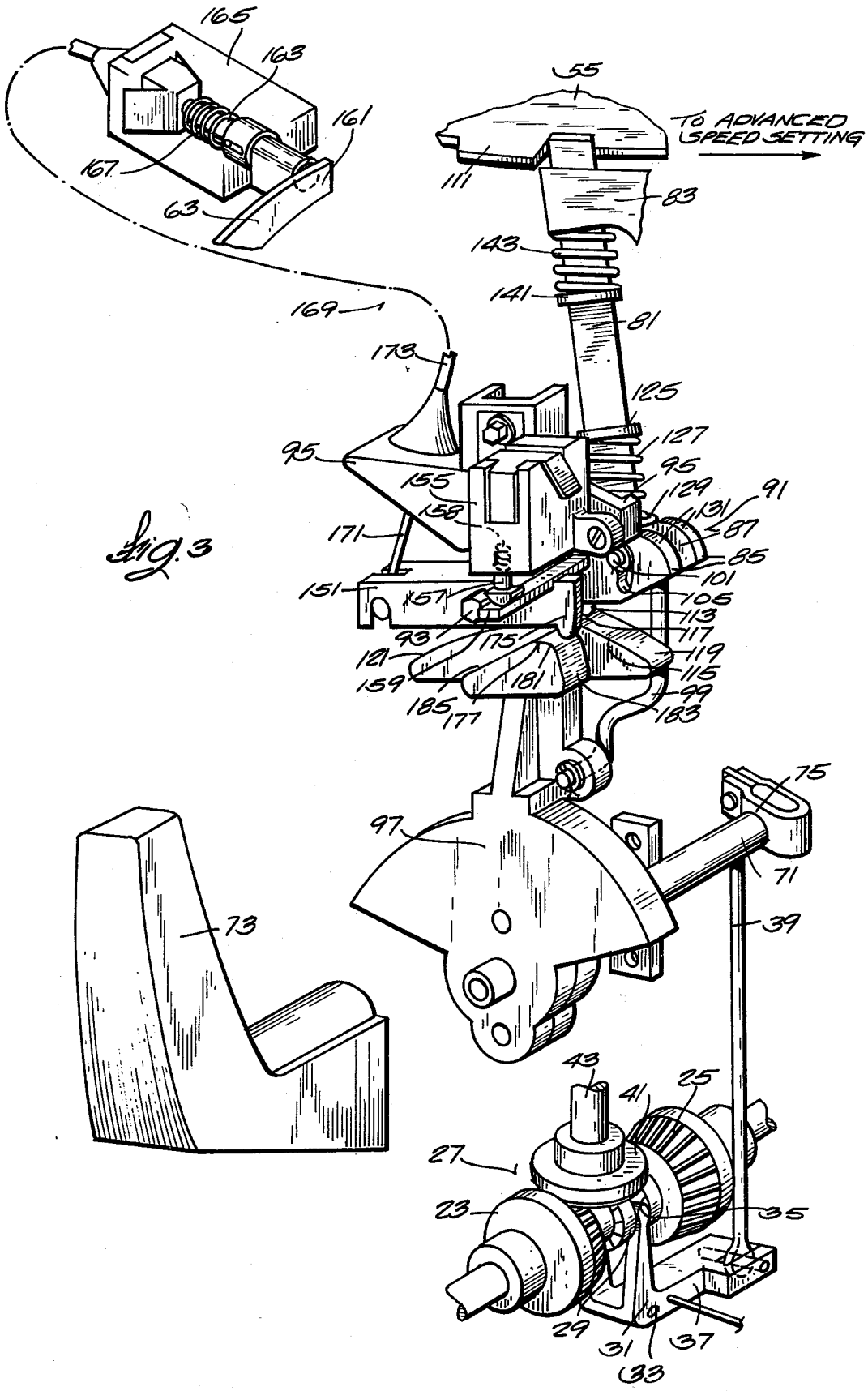
FIG. 3 is an enlarged schematic view, with parts broken away, of a portion of the mechanism included in the outboard motor shown in FIG. 1.

FIG. 4 is a view of the detent lever 91 and the associated cam surface 115 included in the mechanism shown in FIGS. 2 and 3.

Figure 5:
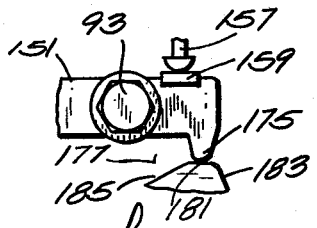

FIG. 5 is a view of the locking lever 151 and associated cam surface 181 and switch actuator 157 included in the mechanism shown in FIGS. 2 and 3.

Figure 6:
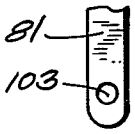

FIG. 6 is a fragmentary view of the bottom of the plunger 81 includes in the mechanism shown in FIGS. 2 and 3.

Before explaining at least one embodiment of the invention in detail, it is to be understood that the invention is not limited in its application to the details of construction and the arrangement of the components set forth in the following description or illustrated in the drawings. The invention is capable of other embodiments and of being practiced and carried out in various ways. Also it is to be understood that the phraseology and terminology employed herein is for the purpose of description and should not be regarded as limiting.

GENERAL DESCRIPTION

Shown in the drawings is a marine propulsion device in the form of an outboard motor 11 including a steerable and tiltable propulsion unit 13 including a lower unit 15 and a power head 17. The lower unit 15 includes a propeller 19 carried by a propeller shaft 21 rotatably mounted in the lower unit 15 and extending through a pair of spaced forward and reverse drive bevel gears 23 and 25 forming a part of a reversing transmission 27. The reversing transmission 27 includes (see also FIG. 3) a clutch dog 29 which is splined to a propeller shaft 21 for rotation therewith and for movement axially thereof between a centered neutral position out of engagement with the bevel gears 23 and 25, a forward drive position in engagement with the forward drive bevel gear 23, and a rearward drive position in engagement with the rearward drive bevel gear 25. The clutch dog 29 is shifted between its three positions by a yoke 31 which is pivotally mounted on a stud 33 in the lower unit 15, which engages an annular groove 35 in the clutch dog 29, and which includes an arm 37 which, at its outer end, is pivotally connected to the lower end of a control link 39 which extends upwardly in the lower unit 15.

The bevel gears 23 and 25 are driven by a drive gear 41 which is enmeshed with both bevel gears 23 and 25 and which is carried on a drive shaft 43 which is suitably rotatably journalled by the lower unit 15 and which extends upwardly in the lower unit 15 for connection to the crankshaft (not shown) of an engine 51 forming part of the power head 17. The engine 51 can be of any suitable construction and includes a throttle 53 (shown schematically) and a timer plate 55 (shown fragmentally) which is connected to the throttle 53 and which is movable to adjust the time of spark ignition in accordance with the setting of the throttle. One such timer plate arrangement is shown in the Soder U.S. Pat. No. 2,906,251 which issued Sept. 29, 1959 and which is incorporated herein by reference.

The engine 51 also conventionally includes a flywheel 57 and suitable means for starting the engine 51, including either or both of an electric starter 59 or a pullrope starter 61, both shown schematically and both including a rotatable member shown fragmentarily at 63 in FIG. 3.

The power head 17 also includes control means for the reversing transmission 27 including (see FIG. 3) a control shaft 71 which is suitably journalled by the power head 17, which is fixedly mounted, at end one, to a shift lever 73 located exteriorally of the power head 17, and which fixedly carries an arm or crank 75 which is pivotally connected to the control link 39 extending upwardly from the lower unit 15 such that pivotal movement of the shift lever 73 from a centered neutral position effects driving engagement of the clutch dog 29 with a selected one of the forward and rearward drive bevel gears 23 and 25 depending on the direction of movement of the shift lever 73 from the centered neutral position.

Connected to the reversing mechanism is mechanism for preventing shifting of the reversing transmission 27 in the event the throttle 53 is located in an advanced setting above idle, for providing a detent action when the reversing transmission 27 in the neutral position, and for biasing the reversing transmission 27 away from the neutural position and into one of the drive positions in the event of the manual release of the reversing transmission 27 from the neutral position, and for precluding starting of the engine 51 in the event the reversing transmission 27 is not in neutral.

Various means can be provided for preventing shifting of the reversing transmission 27 when the throttle 53 is in an advanced position spaced from the idle position. In the disclosed construction, such means comprises a plunger 81 which is guided for movement, near the upper end thereof, by passage through an aperture in a bracket 83 fixed to the power head 17 and which is also guided, adjacent the lower end thereof, by suitable guide means. While various arrangements can be employed, in the disclosed construction, such guide means comprises a pair of spaced legs 85 which define a groove 87 receiving the lower end of the plunger 81 and which are formed on the free end of a detent lever 91 which is mounted for rotary or pivotal movement on a stud 93 extending fixedly from a mounting bracket 95 fixed on the power head 17.

The lower end of the plunger 81 is connected to an arm 97 extending fixedly from the transmission control shaft 71 by a link 99 having, at its lower end, a pivotal connection with the arm 97. At its upper end, the link 99 includes a bent portion 101 which extends through a mating aperture 103 in the lower end of the plunger 81 and through aligned elongated arcuate apertures 105 in the spaced legs 85 of the detent lever 91. More specifically, the arcuate apertures 105 extend along a centerline 107 which extends at a common radius from the stud 93. Accordingly, the link 99 is connected to the plunger 81 for pivotal movement therebetween and the plunger 81 and the link 99 are connected to the detent lever 91 for relative sliding movement within the apertures 105.

The means for preventing movement of the reversing transmission 27 into neutral in the event the throttle 53 is advanced beyond the idle setting also includes, in addition to the link 99 and the plunger 81 already described, interengaging surfaces on the timer plate 55 and on the plunger 81 which interfere to prevent upward plunger movement as the reversing transmission 27 is shifted toward neutral when the throttle 53 and timer plate 55 are in an advance speed setting. Specifically, the timer plate 55 includes a portion 111 which is positionable into interfering location with the respect to the upward path of the upper end of the plunger 81 when the timer plate 55 is in an advanced speed setting and the plunger 81 is raised in response to movement of the transmission toward neutral.

Various means can be provided for providing a detent action when the reversing transmission 27 is in neutral. In the disclosed construction, such means comprises a follower 113 which is located on the detent lever 91 in spaced relation from the stud 93 and which is adapted to engage a cam surface 115 fixed on the arm 97 extending fixedly from the transmission control shaft 71. The cam surface 115 includes a concavely dished central segment 117, together with end segments 119 and 121 which respectively project in opposite directions from the opposite ends of the central segment 117 and which progressively diminish in radial distance from the axis of transmission control shaft rotation with increasing distance from the central segment 117.

Means are provided for biasing the follower 113 into engagement with the cam surface 115 and, in particular, into the dished central segment 117. While various arrangements can be employed, in the illustrated construction, such means comprises a lower annular flange 125 on the plunger 81, together with a helical spring 127 which encircles the plunger 81, which, at one end, bears against the lower annular flange 125 and which, at its other end, bears against a washer 129 which encircles the plunger 81 and rides on arcuate bearing surfaces 131 formed on the spaced legs 85 of the detent lever 91. More particularly, the bearing surfaces 131 extend at a uniform radius from a center 133 located on the aperture centerline 107. Accordingly, the plunger 81 and detent lever 91 are forced apart with the result that the detent lever 97 is biased so as to maintain the follower 113 in engagement with the cam surface 115 on the arm 97 extending from the transmission control shaft 71.

Various means can be provided for biasing the reversing transmission 27 away from the neutral position and into one or the other of the drive positions after manual release of the detent engagement of the follower 113 in the dished central segment 117 of the cam surface 115. In the illustrated construction, such means comprises, in addition to the plunger 81 and the link 99, an upper annular flange 141 on the plunger 81 below the upper bracket 83, together with a biasing helical spring 143 which encircles the plunger 81, which, at one end, bears against the upper bracket 83, and which, at the other end, bears against the upper annular flange 141, thereby urging downwardly the plunger 81 and the link 99 so as to urge the transmission control shaft 71 away from the neutral position after release by the operator of the detent engagement of the follower 113 in the dished central segment 117 of the cam surface 115 on the arm 97. The arcuate apertures 105 in the detent lever 91 permit movement relative thereto of the plunger 81 and link 99.

Various means can be employed for precluding engine starting when the reversing transmission 27 is not in neutral. In the illustrated construction, such means includes a control or locking lever 151 which is suitably movably mounted intermediate the ends thereof on the stud 93 adjacent to the detent lever 91, which is movable to and from a position permitting engine starting, and which prevents engine starting when spaced from the position permitting engine starting.

The means for precluding engine starting can include an electric starter switch 155 which is suitably mounted on the bracket 95 on the power head 17 and which includes an actuator or button 157 which is biased outwardly by suitable spring means 158 to an open position preventing energization of the electric starter 59. The actuator 157 is positioned for engagement by a projection 159 extending from the locking lever 151 such that, when the locking lever 151 is in the position permitting engine starting, the projection 159 engages and depresses the actuator 157 to close an energizing circuit to the electric starter 59. When the locking lever 151 is moved from the position permitting engine starting, the actuator 157 extends and opens the switch, 155 thereby precluding engine starting.

The means for precluding engine starting can also include one or more abutments 161 on a rotary element, such as the rotatable member 63 or the flywheel 57, together with a plunger or blocking member 163 which is guided for movement in a bracket 165 fixed relative to the power head 17 and which is biased by a suitable spring 167 into a position in the rotary path of the abutment 161 so as to preclude engine starting. The plunger 163 is also connected to one end of a flexible cable or linkage 169 which, at its other end, is connected to the end of the lockout lever 151 on the opposite side of the stud 93 from the projection 159. Thus, the biasing spring 167 also serves to yieldable displace the lockout lever 151 away from the position permitting engine starting and so as to engage the projection 159 with the switch button or actuator 157.

As shown, the flexible cable 169 includes an inner core 171 connected to the plunger 163 and to the locking lever 151, together with an outer sheath 173 connected at its opposite ends to points fixed relative to the power head 17, such as the plunger mounting bracket 165 and the mounting bracket 95.

The locking lever 151 is displaced from the position permitting engine starting in response to operation of a follower 175 which is located on the end of the locking lever 151 remote from the end connected to the flexible cable 169 and which engages a cam surface 177 on the arm 97 extending from the transmission control shaft 71. The cam surface 177 includes a short central segment 181 which extends at a common radius from the axis of the transmission control shaft 71 and which is engaged by the follower 175 when the transmission 27 is in neutral. The cam surface 177 also includes respective side segments 183 and 185 which extend from the opposite ends of the short central segment 181 at radial distances from the axis of control shaft rotation which progressively diminish with increasing distance from the short central segment 181.

The follower 175 is biased into engagement with its cam surface 177 through the force of the biasing spring 167 exerted through the cable 169, and/or through bias exerted by the actuator 157 of the switch 155. When the reversing transmission 27 is in neutral, the locking lever 151 is located against the action of the biasing spring 167 in the position permitting engine starting. In the event the transmission is moved from neutral, the side segments 183 and 185 of the cam surface 181 permit movement of the locking lever 151, under the influence of the biasing spring 167 and/or the influence of the switch actuator 157, away from the position permitting engine starting to thereby prevent engine starting.

When the reversing transmission 27 is moved from neutral, the locking lever 151 moves in response to the influence of the biasing spring 167 and/or the action of the switch actuator 157 from the position permitting engine starting, while at the same time, the spring 167 biases the plunger 163 to the position preventing rotation of the associated rotatable element, thereby preventing engine starting. Movement of the locking lever 151 from the engine starting position also serves to open of the starter switch 155, thereby also preventing engine starting.

Thus, the disclosed mechanism provides a detent action and feel when the reversing transmission 27 is in neutral and serves also to bias the reversing transmission 27 away from neutral toward a forward or reverse drive position after manual release of the detent holding the reversing transmission 27 in neutral. Still further and in addition, the mechanism prevents shifting into neutral in the event the throttle is set for a speed above idle. Still further in addition, cooperation between the cam surface 177 and the follower 175 in response to shifting of the transmission 27 from neutral prohibits engine starting either by way of opening a starter motor switch 155 or by way of permitting biased movement of the plunger 163 into interferring position with rotary movement of an element otherwise rotatable by the starting mechanism.

Various of the features of the invention are set forth in the following claims.

We claim:

1. An outboard motor comprising a steerable and tiltable propulsion unit including a transmission shiftable between a neutral position and forward and reverse drive positions, and means for releasably holding said transmission in the neutral position and for biasing said transmission from the neutral position and toward either selected one of said drive positions upon release of said transmission from the neutral position, said means for biasing said transmission from the neutral position and toward the drive positions including a linkage connected to said transmission, said linkage comprising a plunger, means for guiding plunger movement, an arm movable pivotally in response to shifting of said transmission, and a link pivotally connected to said plunger and to said arm, whereby said transmission is shiftable in response to movement of said linkage and said linkage is movable in response to shifting of said transmission, and means biasing said linkage for movement to shift said transmission to either selected one of said drive positions.

2. An outboard motor in accordance with claim 1 wherein said biasing means is operably engaged with said plunger.

3. An outboard motor in accordance with claim 1 wherein said means for releasably holding said transmission in the neutral position includes a cam surface shiftable in response to shifting of said transmission and including a segment having a detent, a follower located for engagement with said cam surface, and means releasably biasing said follower into engagement with said cam surface.

4. An outboard motor comprising a steerable and tiltable propulsion unit including a transmission shiftable between a neutral position and forward and reverse drive positions, and means for releasably holding said transmission in the neutral position and for biasing said transmission from the neutral position and toward either selected one of said drive positions upon release of said transmission from the neutral position, said means for releasably holding said transmission in the neutral position and for biasing said transmission from the neutral position and toward either selected one of said drive positions upon release of said transmission from the neutral position comprising a plunger having first and second ends, means on said propulsion unit for guiding movement of said first plunger end, a detent lever movably mounted on said propulsion unit and including a follower, means for guiding movement of said second plunger end, an arm moveable pivotally in response to shifting of said transmission and including a cam surface including a segment having a detent located for engagement by said follower, means releasably biasing said detent lever for engagement of said follower with said cam surface, a link pivotally connected to said plunger and to said arm, whereby said transmission is shiftable in response to movement of said link and said link is movable in response to shifting of said transmission, and means biasing one of said link and said plunger for movement to shift said transmission to either selected one of said drive positions.

5. An outboard motor comprising a steerable and tiltable propulsion unit including an engine, speed control means movable from an idle speed setting to a range of advanced speed settings, a transmission shiftable between a neutral position and forward and reverse drive positions, and means for releasably holding said transmission in the neutral position, and for biasing said transmission from the neutral position and toward either selected one of said drive positions upon release of said transmission from the neutral position, and for preventing shifting of said transmission to neutral when said speed control means is at a setting advanced from the idle setting.

6. An outboard motor in accordance with claim 5 wherein said speed control means includes a timer plate movable from an idle speed setting to a range of advanced speed settings, and wherein said means for releasably holding said transmission in the neutral position, and for biasing said transmission from the neutral position and toward either selected one of said drive positions upon release of said transmission from the neutral position, and for preventing shifting of said transmission to neutral when said speed control means is at a setting advanced from idle comprises a plunger having first and second ends, means on said propulsion unit for guiding movement of said first plunger end toward and away from said timer plate, a detent lever movably mounted on said propulsion unit and including a follower, and means for guiding movement of said second plunger end, an arm movable pivotally in response to shifting of said transmission and including a cam surface including a segment having a detent, means releasably biasing said detent lever for engagement of said follower with said cam surface, a link pivotally connected to said plunger and to said arm, whereby said transmission is shiftable in response to movement of said plunger and said plunger is movable toward said timer plate and to a first position in response to shifting of said transmission to the neutral position and away from said timer plate in response to shifting of said transmission to either of said drive positions, means biasing one of said link and said plunger for movement to shift said transmission to either selected one of said drive positions, and means on said plunger and on said timer plate for preventing movement on said plunger to said first position, and thereby preventing shifting of said transmission to the neutral position, when said timer plate is at a setting advanced from the idle setting.

7. An outboard motor comprising a steerable and tiltable propulsion unit including an engine, speed control means movable from an idle speed setting to range of advanced speed settings, a starting mechanism operable to start said engine, a transmission shiftable between a neutral position and a drive position, and means connected to said transmission for preventing starting of said engine when said transmission is absent from the neutral position, and for preventing shifting of said transmission to the neutral position when said speed control means is at a setting advanced from the idle setting, and for releasably holding said transmission in the neutral position, and for biasing said transmission from the neutral position and toward the drive position upon release of said transmission from the neutral position.

8. An outboard motor comprising a steerable and tiltable propulsion unit including an engine having a timer plate movable from an idle speed setting to a range of advanced speed settings, a transmission shiftable between a neutral position and a drive position, and means on said timer plate for preventing shifting of said transmission to neutral when said timer plate is at a setting advanced from the idle setting.

9. An outboard motor in accordance with claim 8 wherein said means for preventing shifting of said transmission to neutral when said timer plate is at a setting advanced from the idle speed setting includes a plunger, means guiding said plunger for movement toward and away from said timer plate, a linkage connecting said transmission and said plunger for displacing said plunger toward said timer plate and to a first position in response to shifting of said transmission to the neutral position and for displacing said plunger away from said timer plate in response to shifting of said transmission to the drive position, and means on said plunger and on said timer plate for preventing movement on said plunger to said first position, and thereby preventing shifting of said transmission to the neutral position, when said timer plate is at a setting advanced from the idle setting.

10. An outboard motor comprising a steerable and tiltable propulsion unit including an engine having a timer plate movable from an idle speed setting to a range of advance speed settings, a starting mechanism operable to start said engine, a transmission shiftable between a neutral position and a drive position, means connected to said transmission for preventing starting of said engine when said transmission is absent from the neutral position, and means on said timer plate and operably connected to said transmission for preventing shifting of said transmission to the neutral position when said timer plate is at a setting advanced from the idle setting.

11. An outboard motor comprising a steerable and tiltable propulsion unit including an engine, a starting mechanism operable to start said engine and including an electric starter, a transmission shiftable between a neutral position and a drive position, and means connected to said transmission for preventing starting of said engine when said transmission is absent from the neutral position, said means for preventing engine starting including an arm movable pivotally in response to shifting of said transmission and including a cam surface having a first segment at a first radius from the axis of arm movement and a second segment at a lesser radius from the axis of arm movement, a locking lever including a switch operating portion and a cam follower, means movably mounting said locking lever on said propulsion unit for engagement of said follower with said cam surface and for locking lever movement in response to cam surface movement, a switch controlling energization of said electric starter and including a switch actuator, and means biasing said switch actuator outwardly toward a position preventing energizing of said electric starter, and means mounting said switch on said propulsion unit for engagement of said switch actuator with said switch operating portion of said locking lever so as to bias said locking lever follower into engagement with said cam surface and thereby to depress said actuator to permit energizing of said electric starter when said follower engages said first segment of said cam surface and to permit outward movement of said actuator to prevent energizing of said electric starter when said follower engages said second segment.

12. An outboard motor comprising a steerable and tiltable propulsion unit including an engine, a starting mechanism operable to start said engine and including a rotatable element including an abutment, a transmission shiftable between a neutral position and a drive position, and means connected to said transmission for preventing starting of said engine when said transmission is absent from the neutral position, said means for preventing engine starting including an arm pivotally movable in response to shifting of said transmission and including a cam surface having a central segment at a first radius from the axis of arm movement and a second segment at a lesser radius from the axis of arm movement, a locking lever including a cam follower, means movably mounting said locking lever on said propulsion unit for engagement of said follower with said cam surface and for locking lever movement in response to cam surface movement, a blocking member, means mounting said blocking member on said propulsion unit for movement between a retracted position permitting starting of said engine and an extended position located to interfere with rotary movement of said abutment so as to preclude rotation of said element, linkage means connecting said blocking member and said locking lever for moving one of said locking lever and said blocking member in response to movement of the other of said blocking member and said locking lever, and means biasing one of said linkage, said blocking member, and said locking lever for locating said blocking member in the extended position and to bias said locking lever follower into engagement with said cam surface, thereby to locate said blocking member in the retracted position when said follower engages said first segment of said cam surface and to locate said blocking member in the extended position when said follower engages said second segment of said cam surface.

13. An outboard motor comprising a steerable and tiltable propulsion unit including an engine, a starting mechanism operable to start said engine and including an electric starter and a rotatable element including an abutment, a transmission shiftable between a neutral position and a drive position, and means connected to said transmission for preventing starting of said engine when said transmission is absent from the neutral position, said means for preventing engine starting including an arm movable pivotally in response to shifting of said transmission and including a cam surface having a first segment at a first radius from the axis of arm movement and a second segment at a lesser radius from the axis of arm movement, a locking lever including a switch operating portion and a cam follower, means movably mounting said locking lever on said propulsion unit for engagement of said follower with said cam surface and for locking lever movement in response to cam surface movement, a switch controlling energizing of said electric starter and including a switch actuator, and means biasing said switch actuator outwardly toward a position preventing energizing of said electric starter, means mounting said switch on said propulsion unit for engagement of said switch actuator with said switch operating portion of said locking lever so as to bias said locking lever follower into engagement with said cam surface, a blocking member, means mounting said blocking member on said propulsion unit for movement between a retracted position permitting starting of said engine and an extended position located to interfere with rotary movement of said abutment so as to preclude rotation of said element, a linkage connecting said blocking member and said locking lever for moving one of said locking lever and said blocking member in response to movement of the other of said blocking member and said locking lever, and means biasing one of said linkage, said blocking member and said locking lever so as to locate said blocking member in the extended position and to bias said locking lever follower into engagement with said cam surface, which biasing of said locking lever follower into engagement with said cam surface serving, when said follower engages said first segment of said cam surface, to depress said actuator to permit energizing of said electric starter, and to locate said blocking member in the retracted position thereby permitting engine starting and, when said follower engages said second segment, to permit outward movement of said actuator to prevent energizing of said electric starter and to locate said blocking member in the extended position, thereby preventing engine starting.

14. An outboard motor comprising a steerable and tiltable propulsion unit including an engine, speed control means movable from an idle speed setting to a range of advanced speed settings, a transmission shiftable between a neutral position and a drive position, means for releasably holding said transmission in the neutral position comprising an arm movable pivotally in response to shifting of said transmission and including a cam surface having a dished detent segment at a first radius from the axis of arm movement and a second segment at a lesser radius from the axis of arm movement, a detent lever movably mounted on said propulsion unit and including a follower located for engagement with said cam surface, and means releasably biasing said detent lever for engagement of said follower with said cam surface, and means for preventing shifting of said transmission to the neutral position when said speed control means is at a setting advanced from neutral.

* * * * *